US012276129B2

(12) United States Patent
Shen

(10) Patent No.: US 12,276,129 B2
(45) Date of Patent: Apr. 15, 2025

(54) SWIMMING POOL COVER AND METHOD FOR ASSEMBLING THE SAME

(71) Applicant: Long Xiang Shen, San Bernardino, CA (US)

(72) Inventor: Long Xiang Shen, San Bernardino, CA (US)

( * ) Notice: Subject to any disclaimer, the term of this patent is extended or adjusted under 35 U.S.C. 154(b) by 249 days.

(21) Appl. No.: 18/109,513

(22) Filed: Feb. 14, 2023

(65) Prior Publication Data

US 2024/0271441 A1 Aug. 15, 2024

(51) Int. Cl.
*E04H 4/10* (2006.01)

(52) U.S. Cl.
CPC ..... *E04H 4/10* (2013.01)

(58) Field of Classification Search
CPC ..... E04H 4/10; E04H 4/06
USPC ..... 4/498
See application file for complete search history.

(56) References Cited

U.S. PATENT DOCUMENTS 3,520,004 A * 7/1970 Patnaude ..... E04H 4/10 24/265 R
4,916,763 A * 4/1990 Christensen ..... E04H 4/10 267/71
5,014,369 A * 5/1991 Daus ..... E04H 4/10 24/324
6,286,157 B1 * 9/2001 Baumann ..... E04H 4/103 4/503
2012/0073039 A1 * 3/2012 Hotaling ..... E04H 4/10 4/498
2012/0278987 A1 * 11/2012 Marelli ..... E04H 4/10 4/503
2019/0136559 A1 * 5/2019 Dershem ..... E04H 4/14
2021/0381187 A1 * 12/2021 Pickel ..... E04H 4/06

* cited by examiner

*Primary Examiner* — Huyen D Le
(74) *Attorney, Agent, or Firm* — Ying-Ting Chen; Law Office of Michael Chen

(57) ABSTRACT

A swimming pool cover system includes at least one retaining assembly configured for attachment of a flexible pool cover with a pool deck; at least one adjusting assembly configured for extending and retracting the flexible pool cover, and at least one rolling support assembly attached along edges of the flexible pool cover and configured for tightening the flexible pool cover.

20 Claims, 15 Drawing Sheets

SWIMMING POOL COVER AND METHOD FOR ASSEMBLING THE SAME

FIELD OF THE DISCLOSURE

The present disclosure relates to a swimming pool cover, and more particularly to the swimming pool cover which has a detachable configuration, and a method for assembling the swimming pool cover. Although the present disclosure is suitable for a wide scope of applications, it is particularly suitable for the swimming pool cover to be efficiently expanded and retracted over on the pool surface.

BACKGROUND OF THE DISCLOSURE

The modern homeowner is constantly seeking ways to incorporate more recreational and exercise facilities in and around the home. In recent years, the backyard swimming pool has increasingly become a popular addition as an at-home recreational outlet. A major drawback, however, is that maintenance of a pool requires a considerable expenditure of time. This time spent for maintenance cuts into the time that might be spent for relaxation and desired exercise. One way to shorten the maintenance time is to provide a suitable cover for a daily or even weekly application on the pool. By providing a cover, debris, insects, and animals cannot contaminate the pool and discolor the water when the pool is not in use. A lightweight cover for an above-ground pool, which cover can be securely installed and quickly removed, would certainly be a welcome addition to the art. However, covers heretofore known have been bulky, difficult to install and, in general, unattractive in appearance.

Manual winding of the cover for deployment over the pool or for retraction onto the shaft is often time consuming and difficult. It has been proposed to provide an electric motor to wind-in and wind-out the cover. However, installation of electrical equipment in or around a pool presents considerable safety concerns and maintenance problems.

There may exist a desire to develop an efficient tool assembly to facilitate the user to manually expand and retract the cover over the swimming pool.

All referenced patents, applications and literatures are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In a general implementation, a swimming pool cover system may further comprise at least one retaining assembly configured for attachment of a flexible pool cover on a pool deck; at least one adjusting assembly configured for extending and retracting the flexible pool cover; and at least one rolling support assembly attached along edges of the flexible pool cover and configured for tightening the edges the flexible pool cover.

In another aspect combinable with the general implementation, the retaining assembly may comprise a securing member mounted on the pool deck and a first belt member connected between the flexible pool cover and the securing member.

In another aspect combinable with the general implementation, the retaining assembly may comprise a securing member having a securing plate and an affixing unit passed through the securing plate to secure the securing plate and the affixing unit on the pool deck.

In another aspect combinable with the general implementation, the adjusting assembly may comprise a second belt member and an adjusting unit coupled with the second belt member, wherein the adjusting unit is configured to increase or decrease a length of the adjusting assembly.

In another aspect combinable with the general implementation, the adjusting assembly may comprise a second belt member and an adjusting unit coupled with the second belt member, wherein the adjusting unit comprises one end coupled with a second belt member and an opposite end coupled with the retaining assembly.

In another aspect combinable with the general implementation, the adjusting assembly comprises a second belt member having one end coupled with the adjusting unit and having an opposite end coupled with the flexible pool cover while the adjusting unit is coupled with a first side belt member of a first belt member of the retaining assembly.

In another aspect combinable with the general implementation, the adjusting assembly comprises a second belt member having one end coupled with the adjusting unit and having an opposite end coupled with an opposite end of a first corner belt member of the first belt member of the retaining assembly while the adjusting unit is coupled with one end of a first corner belt member of a first belt member of the retaining assembly.

In another aspect combinable with the general implementation, the rolling support assembly may comprise a first locking member detachably connected with a second locking member, and a rotatable central unit detachably connected with the first locking member and the second locking member.

In another aspect combinable with the general implementation, the rolling support assembly may comprise a rotatable central unit and a shaping rope surrounding edges of the flexible pool cover, wherein the shaping rope passes through the rotatable central unit.

In another aspect combinable with the general implementation, the rotatable central unit is clockwisely or counterclockwisely rotated to increase or decrease a length of the shaping rope selectively.

Accordingly, the present disclosure is directed to a method of assembling a swimming pool cover system comprising steps of:

- attaching a flexible pool cover on a pool deck by a retaining assembly;
- extending and retracting the flexible pool cover by an adjusting assembly; and
- tightening the flexible pool cover along edges of the flexible pool cover by the rolling support assembly.

Among the many possible implementations of the method of assembling the swimming pool cover system, the step of attaching the flexible pool cover further comprises steps of:

- mounting a securing member of the retaining assembly on the pool deck; and
- connecting the flexible pool cover with the securing member by a first belt member of the retaining assembly.

Further, it is contemplated that the step of attaching the flexible pool cover further comprises steps of:

placing a securing plate of a securing member of the retaining assembly on a pool deck; and passing an affixing unit of the securing member through the securing plate to secure the securing plate and the affixing unit on the pool deck.

In the alternative, the step of attaching the flexible pool cover further comprises steps of:

coupling an adjusting unit of the adjusting assembly with a second belt member of the adjusting assembly; and increasing or decreasing a length of the adjusting assembly by the adjusting unit.

It is still further contemplated that the step of extending and retracting the flexible pool cover further comprises steps of:

coupling one end of a second belt member of the adjusting assembly with an adjusting unit of the adjusting assembly;

coupling an opposite end of the second belt member of the adjusting assembly with an opposite end of a first belt member of the retaining assembly;

coupling the adjusting unit with one end of the first corner belt member of the first belt member of the retaining assembly; and increasing or decreasing a length of the adjusting assembly by the adjusting unit.

Another aspect of the embodiment is directed to methods of assembling a swimming pool cover system, wherein the step of extending and retracting the flexible pool cover further comprises steps of:

coupling one end of a second belt member with an adjusting unit;

coupling an opposite end of the second belt member of the adjusting assembly with the flexible pool cover;

coupling the adjusting unit with one end of the first side belt member of the first belt member of the retaining assembly; and increasing or decreasing a length of the adjusting assembly by the adjusting unit.

Accordingly, the step of tightening the flexible pool cover further comprises steps of:

connecting a first locking member of the rolling support assembly with a second locking member of the rolling support assembly;

connecting a rotatable central unit with the first locking member and the second locking member;

passing a shaping rope through the rotatable central unit; and clockwisely or counter-clockwisely rotating the rotatable central unit to increase or decrease a length of the shaping rope selectively.

It should be noted that a method of assembling a swimming pool cover system may further comprise a step of providing a shaping rope surrounding edges of the flexible pool cover.

Moreover, the first locking member, the second locking member, and the rotatable central unit are detachable from each other.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

It shall be understood that the term "means," as used herein, shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

Unless defined otherwise, all technical and position terms used herein have the same meaning as commonly understood by one of ordinary skill in the art to which the invention pertains. Although many methods and materials similar, modified, or equivalent to those described herein can be used in the practice of the present invention without undue experimentation, the preferred materials and methods are described herein. In describing and claiming the present invention, the following terminology will be used in accordance with the definitions set out below.

Figure 1:
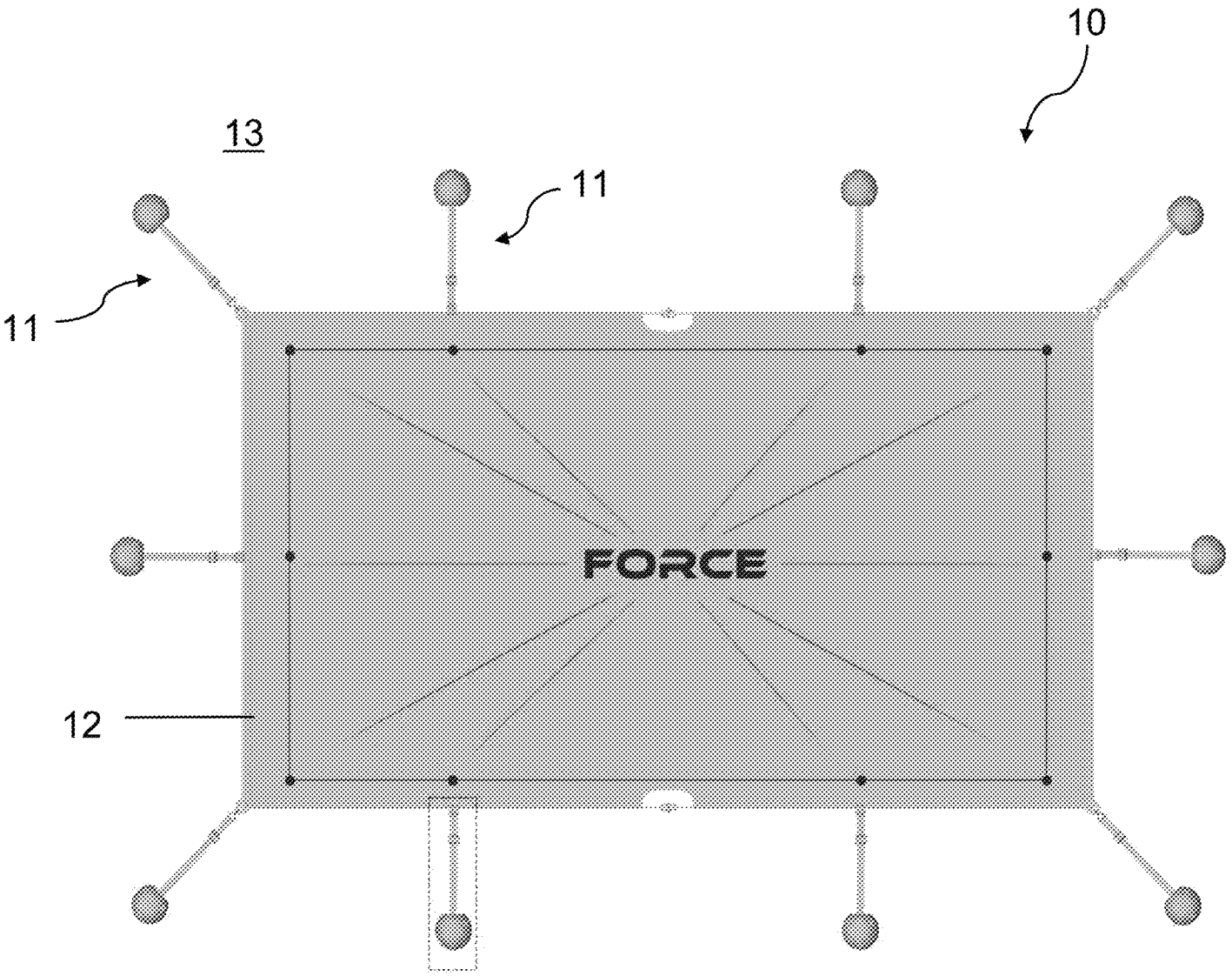
FIG. 1 is a perspective view of a system of a swimming pool cover according to an aspect of the embodiment.

FIG. 1 generally depicts a swimming pool cover system 10 according to an embodiment.

Referring to FIG. 1, the swimming pool cover system 10 may comprise at least one retaining assembly 11 configured for attachment of a flexible pool cover 12 with a pool deck 13, wherein the retaining assembly 11 may be surrounding edges of the flexible pool cover 12. In one embodiment, the retaining assembly 11 may be attached to the edges of the flexible pool cover 12 to extend or retract the flexible pool cover 12.

FIGS. 2-5 generally depict the retaining assembly 11 of the swimming pool cover system 10 according to an embodiment.

Figure 2:
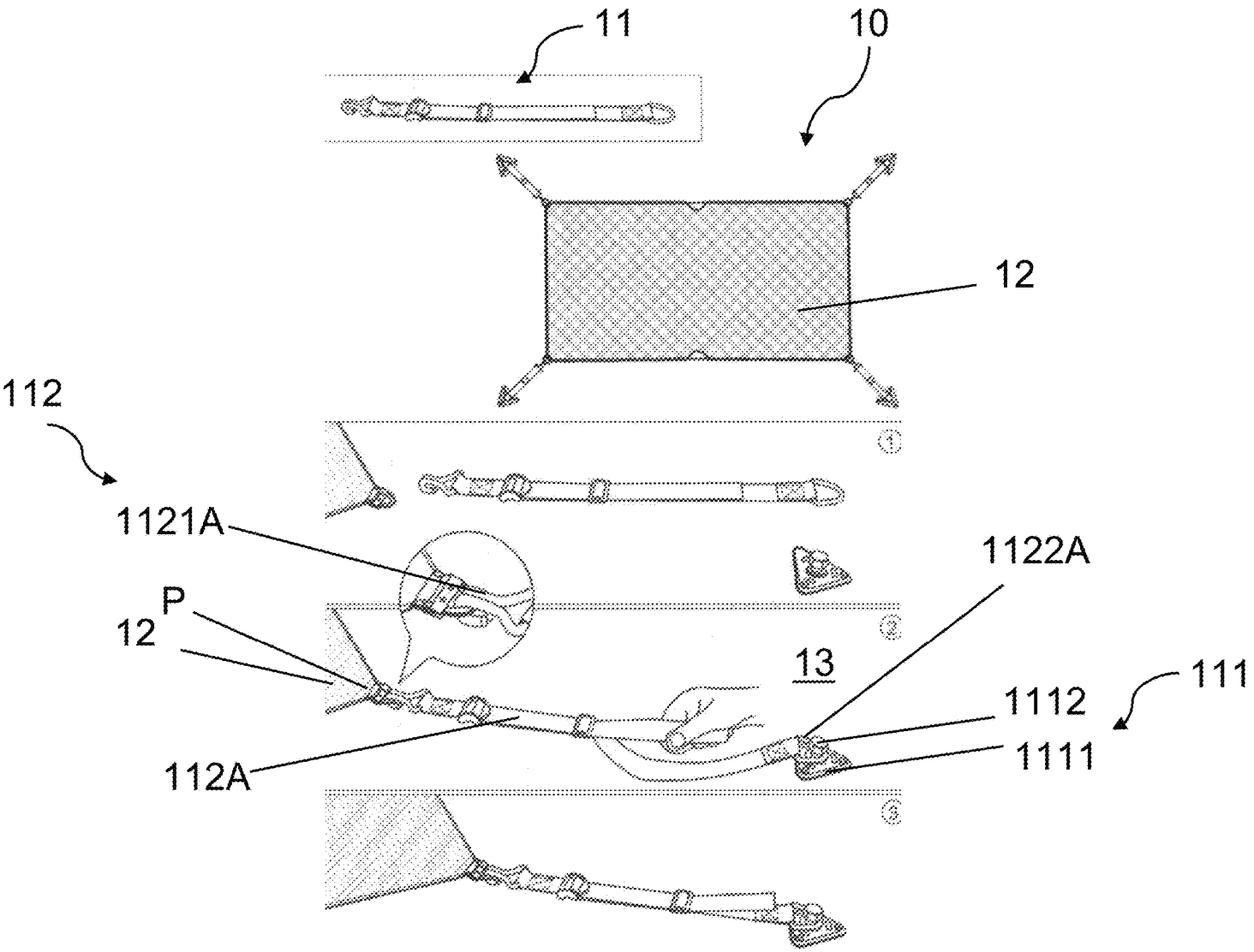
FIG. 2 is a perspective view of a retaining assembly of the swimming pool cover system according to an aspect of the embodiment.

Referring to FIG. 2, the retaining assembly 11 may comprise a securing member 111 mounted on the pool deck 13 and a first belt member 112 connected between the flexible pool cover 12 and the securing member 111. In one embodiment, the securing member 111 may have a securing plate 1111 and an affixing unit 1112 passed through the securing plate 1111 to secure the securing plate 1111 and the affixing unit 1112 on the pool deck 13, wherein one end of the first belt member 112 may be connected with the securing member 1111, and an opposite end of the first belt member 112 may be connected to the flexible pool cover 12.

It should be noted that, in one embodiment, a length of the first belt member 112 may be adjusted. For example, the first belt member 112 may have a belt-like configuration, and the length of the first belt member 112 may be adjusted by the belt-like configuration.

In still one embodiment, the first belt member 112 may comprise a first corner belt member 112A, wherein the first corner belt member 112A may comprise a first hooking unit 1121A coupled to one end of the first corner belt member 112A and a first corner belt retaining unit 1122A coupled to an opposite end of the first corner belt member 112A, wherein the first hooking unit 1121A may be attached on a point "P" formed by two edges of the flexible pool cover 12 and the first corner belt retaining unit 1122A may be attached with the securing member 111. For example, the first hooking unit 1121A may be a hook.

It should be understood that the above-described first hooking unit 1121A is exemplary, and any other types of first hooking unit 1121A can be adopted in various embodiments of this disclosure.

Figure 3:
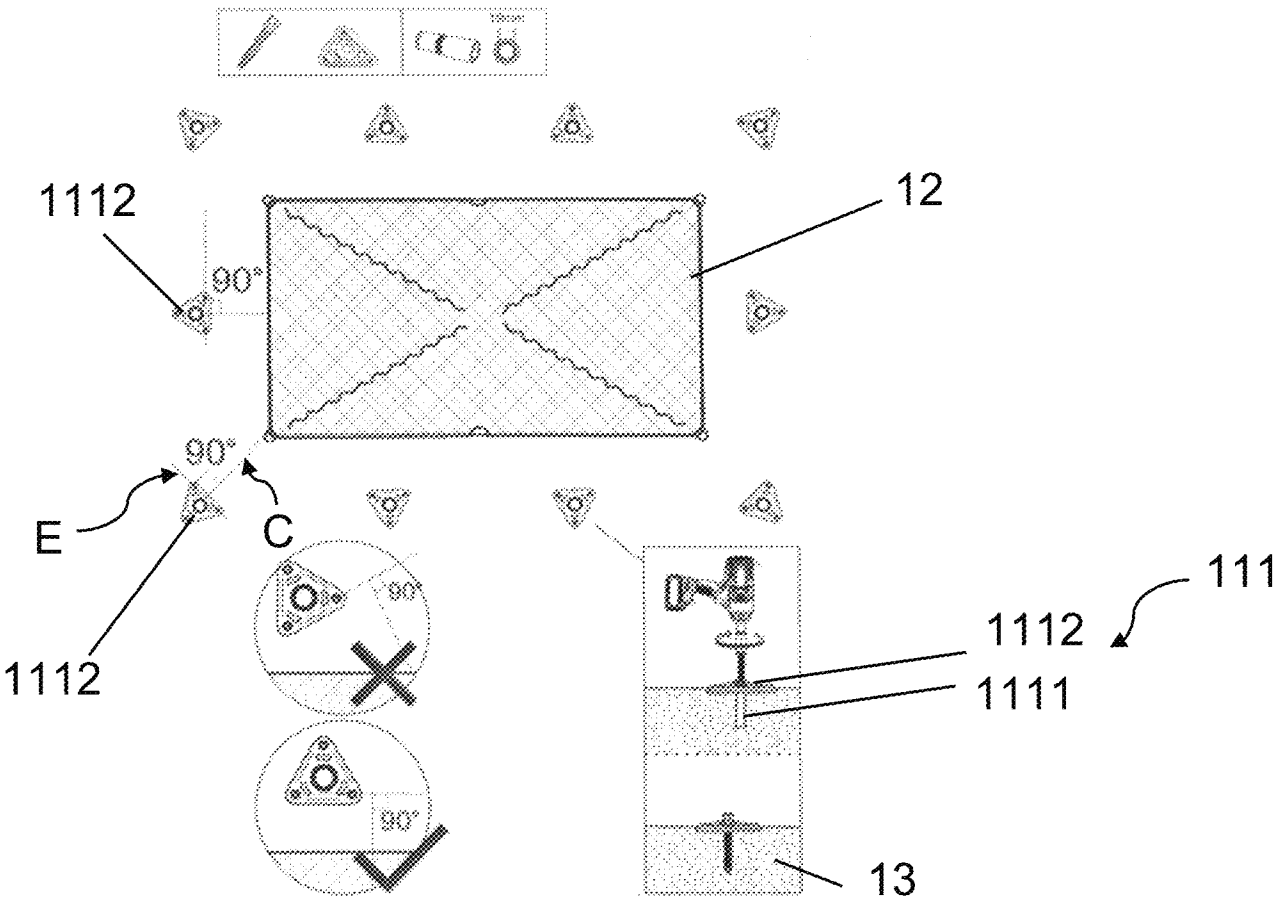
FIG. 3 is a perspective view showing a plurality of securing plates located around the flexible pool cover according to an aspect of the embodiment.

In another embodiment, referring to FIG. 3, the securing plate 1112 may be placed on the pool deck 13, and the affixing unit 1111 may be knocked into the pool deck 13. In one embodiment, at least one securing plate 1112 may be placed around the flexible pool cover 12. In another embodiment, each of the securing plates 1112 may define a central line "C" and an edge line "E" formed along any one of the edges of the securing plate 1112, wherein the securing plate 1112 may be placed on a location where the central line "C" has formed an angle of nighty degrees with respect to the edge line "E."

In still another embodiment, the securing plate 1112 may be a triangle. It should be understood that the above-described angle and shape of the securing plate 1112 are exemplary, and any other angles/shape of the securing plate 1112 can be adopted in various embodiments of this disclosure.

Figure 4:
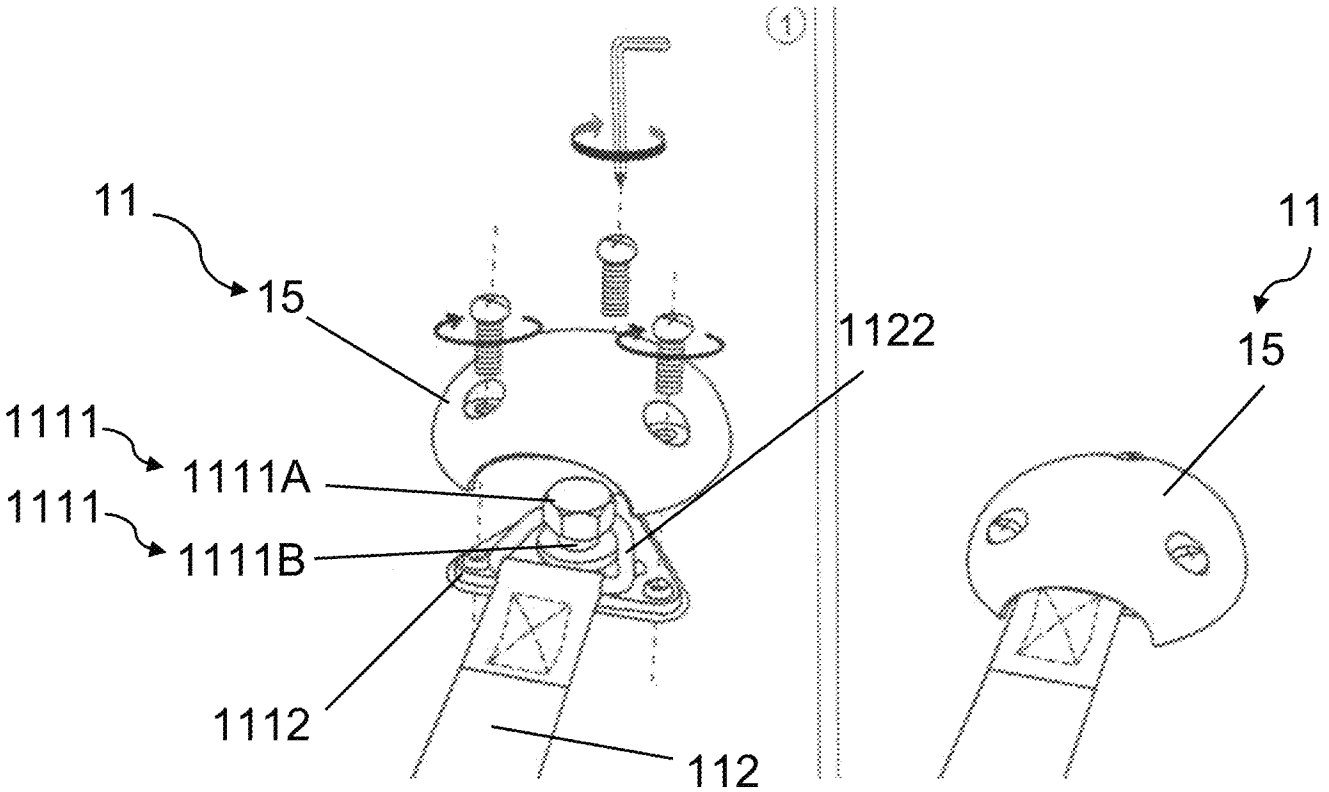
FIG. 4 is a sectional view of a securing member according to an aspect of the embodiment.

Referring to FIG. 4, in one embodiment, the retaining assembly 11 may further comprise a protection cover 15 covered on the securing plate 1112 and the affixing unit 1111. In still embodiment, the affixing unit 1111 may have a bolt-like structure, wherein the affixing unit 1111 may comprise a bolt top 1111A and a bolt body 1111B, and in such a manner, while the affixing unit 1111 is passed through the securing plate 1112, the retaining unit 1122 coupled to the one end of the first belt member 112 may be secured between the bolt top 1111A and the securing plate 1112. In other words, the retaining unit 1122 may be locked on the securing member 111.

Figure 5:
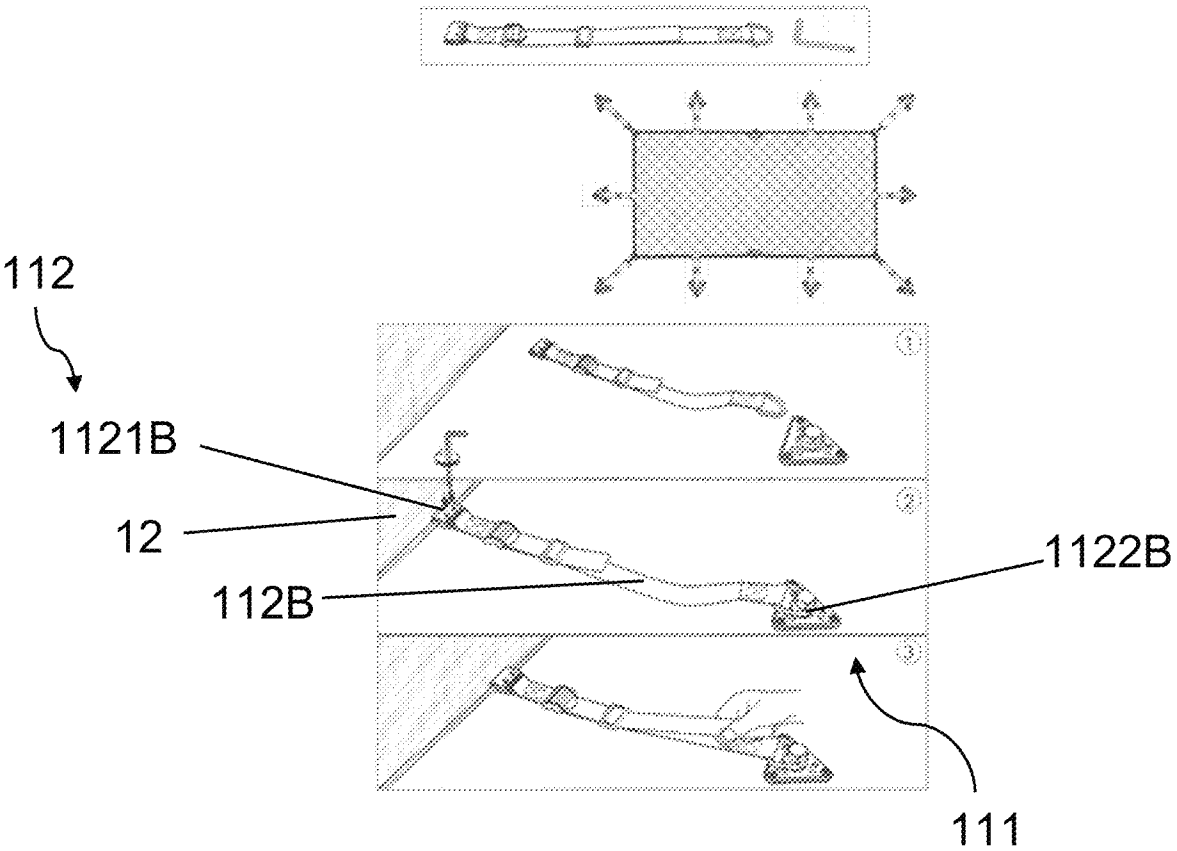
FIG. 5 is a perspective view of a retaining assembly of the swimming pool cover system according to an aspect of the embodiment.

Referring to FIG. 5, in still one embodiment, the first belt member 112 may comprise a first side belt member 112B having a first clipping unit 1121B coupled to an opposite end of the first side belt member 112B and a first side belt retaining unit 1122B coupled to one end of the first side belt member 112B, wherein the first clipping unit 1121B may be attached on the edge of the flexible pool cover 12 and the first side belt retaining unit 1122B may be attached with the securing member 111. For example, the first clipping unit 1121B may be a clip.

It should be understood that the above-described first clipping unit 1121B is exemplary, and any other types of first clipping unit 1121B can be adopted in various embodiments of this disclosure.

Figure 6:
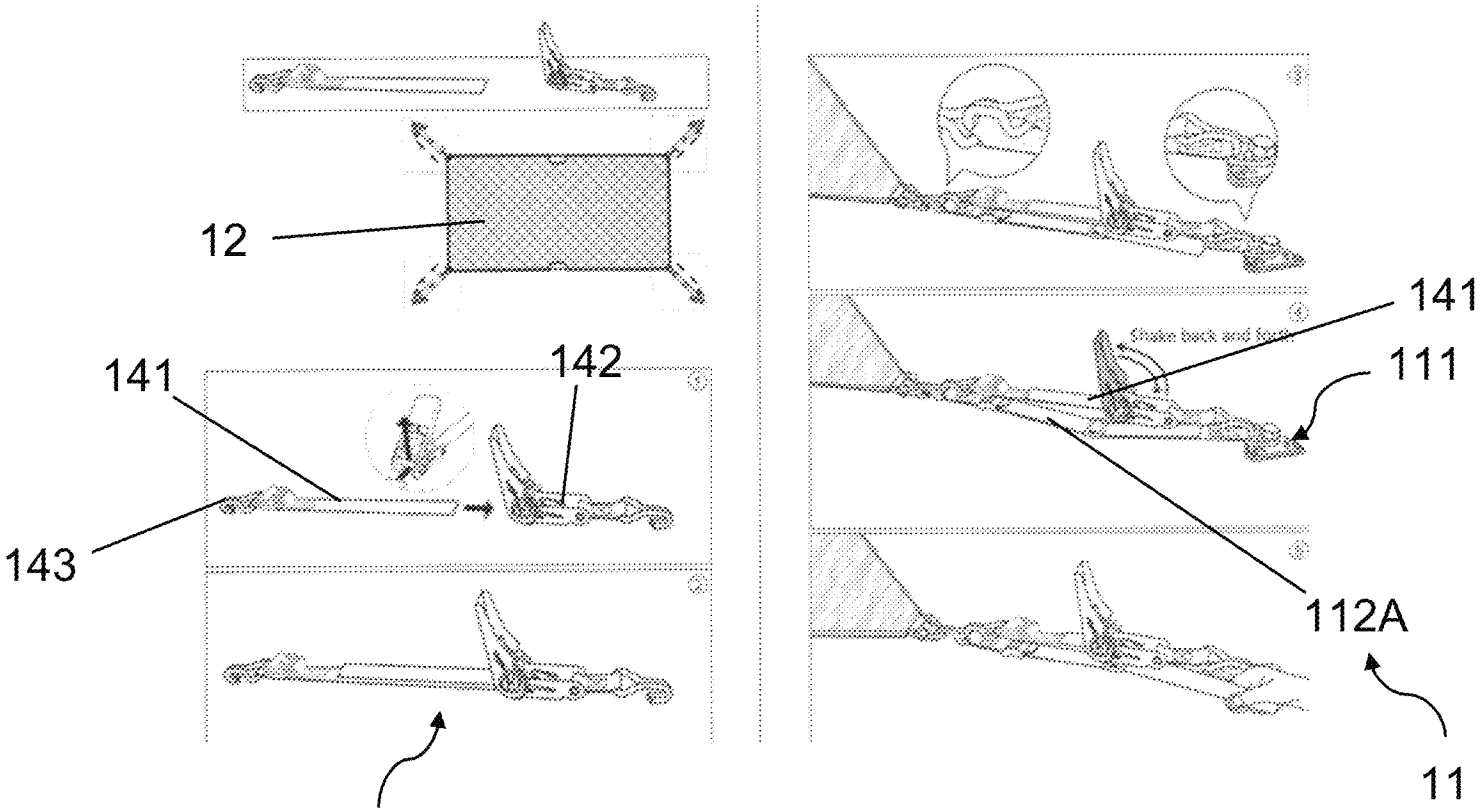
FIG. 6 is a perspective view of an adjusting assembly of the swimming pool cover system according to an aspect of the embodiment.
Figure 7:
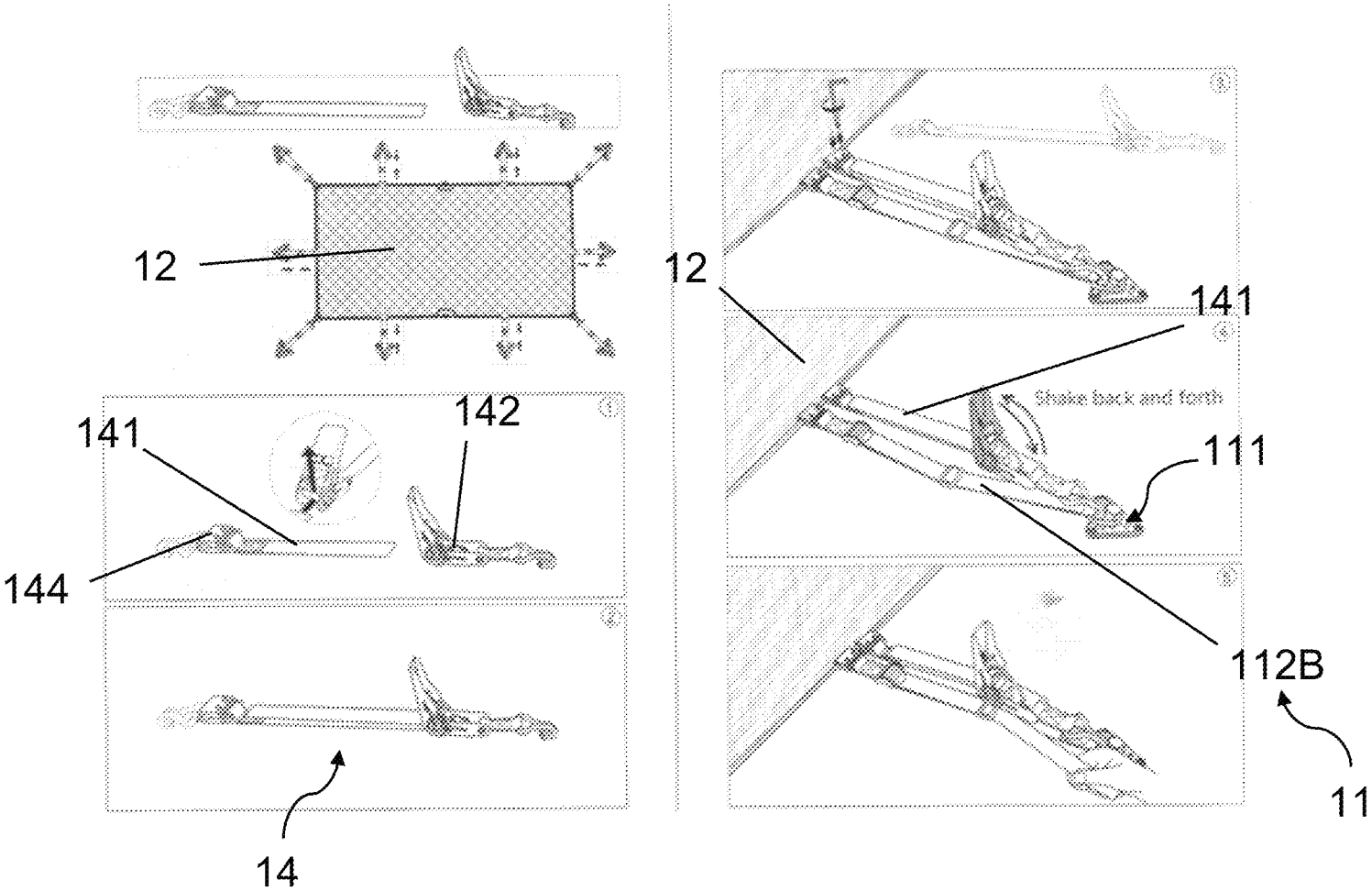
FIG. 7 is a perspective view showing an adjusting assembly incorporated with the retaining assembly according to an aspect of the embodiment.

FIGS. 6-7 generally depict an adjusting assembly 14 of the swimming pool cover system according to an embodiment.

Referring to FIG. 6, the adjusting assembly 14 may be configured for extending and/or retracting the flexible pool cover 12.

In one embodiment, the adjusting assembly 14 may comprise a second belt member 141 and an adjusting unit 142 coupled with the second belt member 141, wherein the second belt member 141 may have one end coupled with the adjusting unit 142 and may have an opposite end coupled with the first belt member 112 of the retaining assembly 11.

In one embodiment, the adjusting unit 142 may be configured to increase or decrease a length of the adjusting assembly 14, wherein the adjusting unit 142 may be configured to increase or decrease a length of the second belt member 141 while the one end of the second belt member 141 is attached on the first corner belt member 112A. At the same time, the first corner belt member 112A may be coupled with the flexible pool cover 12, so a distance between the flexible pool cover 12 and the securing member 111 may be simultaneously decreased or increased. While the distance between the flexible pool cover 12 and the securing member 111 is affixed at a predetermined distance through the adjusting assembly 14, the length of the first corner belt member 112A may be adjusted to match with the predetermined distance.

In still one embodiment, the adjusting assembly 14 may comprise a second hooking unit 143 attached to the opposite end of the second belt member 141 and the one end of the second belt member 141 may be coupled to the adjusting unit 142, wherein the second hooking unit 143 may be coupled to an opposite end of the first corner belt member 112A and the adjusting unit 142 may be coupled to one end of the first corner belt member 112A. In still one embodiment, the opposite end of the first corner belt member 112A may be opposite of the one end of the first corner belt member 112A.

Referring to FIG. 7, in another embodiment, the adjusting assembly 14 may comprise a second clipping unit 144 attached to the flexible pool cover 12 and the one end of the second belt member 141 may be coupled to the adjusting unit 142. In one embodiment, while the second clipping unit 144 is coupled to the flexible pool cover 12, the adjusting unit 142 is coupled to the one end of the first side belt member 112B.

Figure 8:
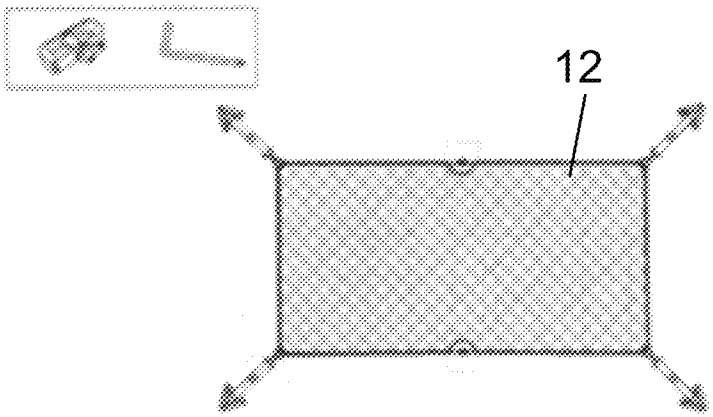
FIG. 8 is an exploded view of an adjusting unit of the adjusting assembly according to an aspect of the embodiment.
Figure 8:
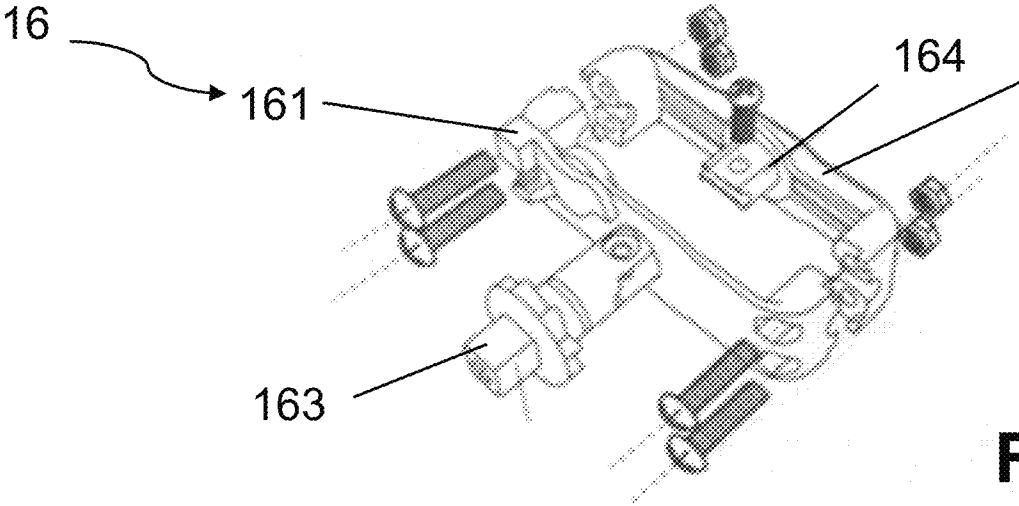
Figure 9:
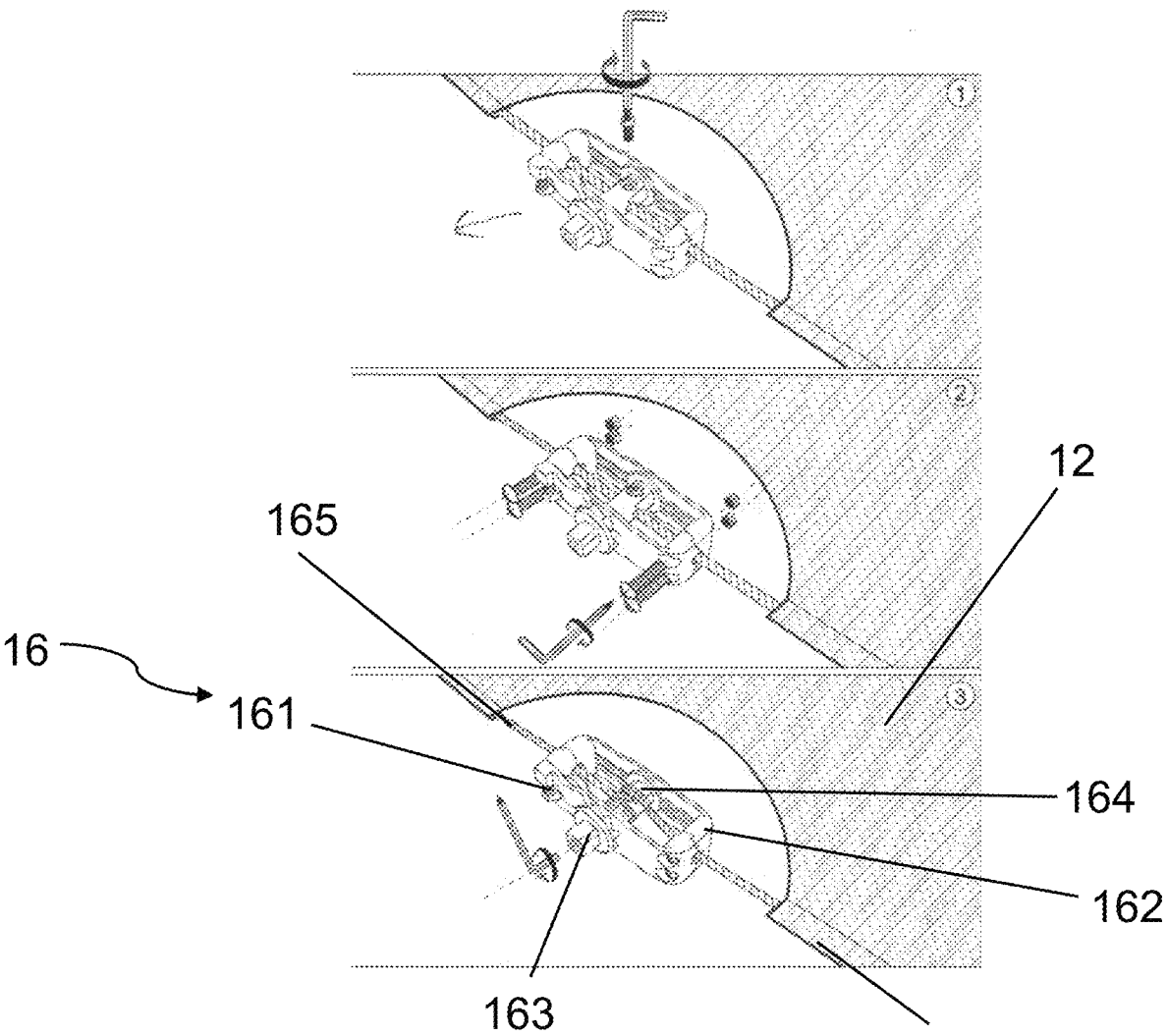
FIG. 9 is a perspective view of the adjusting unit of the adjusting assembly incorporated with the flexible pool cover according to an aspect of the embodiment.

FIGS. 8-9 generally depict a rolling support assembly 16 of the swimming pool cover system according to an embodiment.

Referring to FIG. 8, in one embodiment, the rolling support assembly 16 may be attached along edges of the flexible pool cover 12 and may be configured for tightening the flexible pool cover 12.

In still one embodiment, the rolling support assembly 16 may comprise a first locking member 161 detachably connected with a second locking member 162, and a rotatable central unit 163 detachably connected with the first locking member 161 and the second locking member 162.

In another embodiment, the second locking member 162 may comprise a protrusion 164 extending from the second locking member 162 towards the first locking member 161. In still another embodiment, the rotatable central unit 163 may be detachably engaged with the first locking member 161 and may be detachably engaged with the protrusion 164.

Referring to FIG. 9, in one embodiment, the rolling support assembly 16 may comprise a shaping rope 165 surrounding edges of the flexible pool cover 12, wherein the shaping rope 165 may be configured to maintain a shape of the flexible pool cover 12.

Continuing to FIG. 9, in one embodiment, while the protrusion 164 of the second locking member 162 is received within the rotatable central unit 163, the shaping rope 165 may pass through the rotatable central unit 163, and at the same time, the rotatable central unit 163 may pass through the first locking member 161. In still embodiment, the first locking member 161, the second locking member 162, the rotatable central unit 163, and the protrusion 164 may be detachable from each other.

As shown in further details of FIG. 9, in one embodiment, the rotatable central unit 163 may be clockwisely or counter-clockwisely rotated to selectively increase or decrease a length of the shaping rope 165 (engage with or release the shaping rope 165). In one embodiment, the shaping rope 165 may gradually surround the rotatable central unit 163 to decrease the length of the shaping rope 165 and gradually release from the rotatable central unit 163 to increase the length of the shaping rope 165.

In still one embodiment, the flexible pool cover 12 may comprise sleeves 121 formed on the edges of the flexible pool cover 12, wherein the shaping rope 165 may be received inside the sleeves 121.

In still one embodiment, for example, while the length of the shaping rope 165 is decreased, the sleeves 121/edges of the flexible pool cover 12 may be tightened.

In still one embodiment, for another example, while the length of the shaping rope 165 is increased, the sleeves 121/edges of the flexible pool cover 12 may be released.

FIGS. 10-15 generally depict a method 200 of assembling a swimming pool cover system according to an embodiment.

Figure 10:
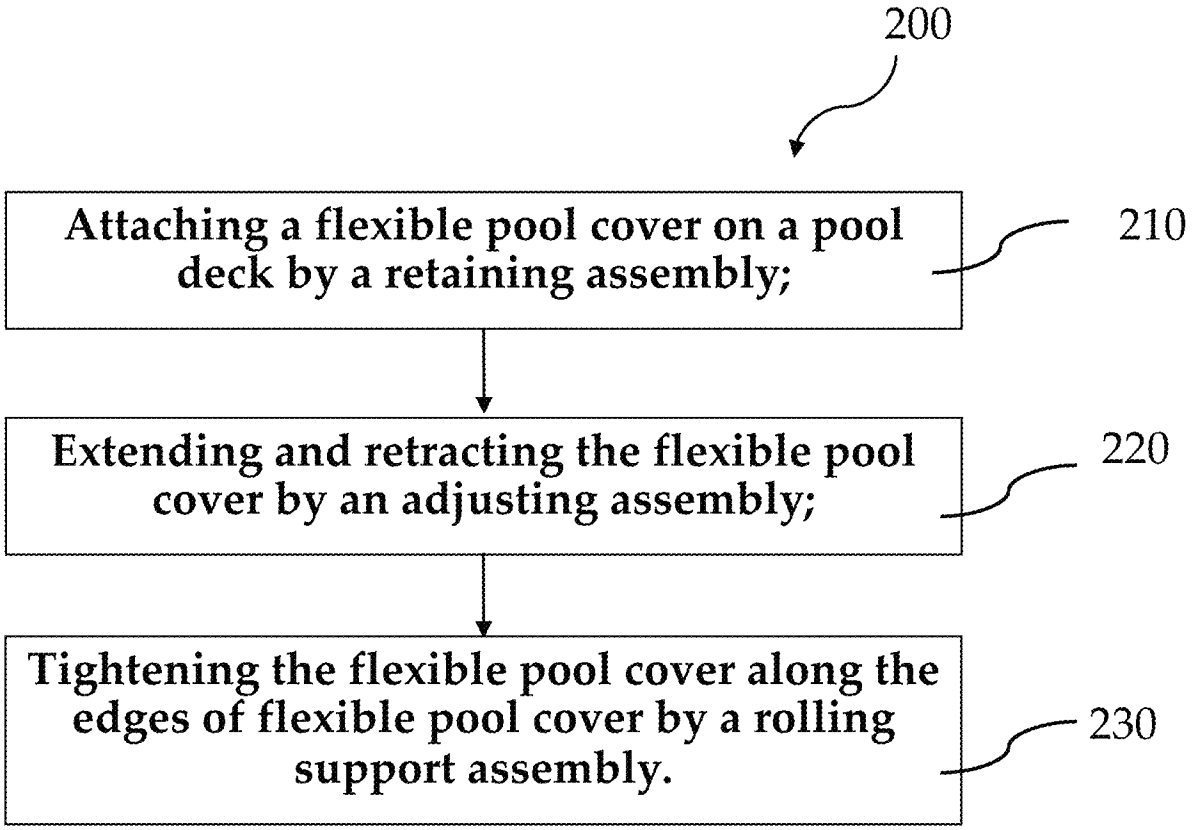
FIGS. 10-15 are block diagrams of a method of assembling the swimming pool cover system according to an aspect of the embodiment.

Referring to FIG. 10, the method 200 of assembling the swimming pool cover system comprises steps of:

- attaching a flexible pool cover on a pool deck by a retaining assembly 210;
- extending and retracting the flexible pool cover by an adjusting assembly 220; and
- tightening the flexible pool cover along edges of the flexible pool cover by a rolling support assembly 230.

Figure 11:
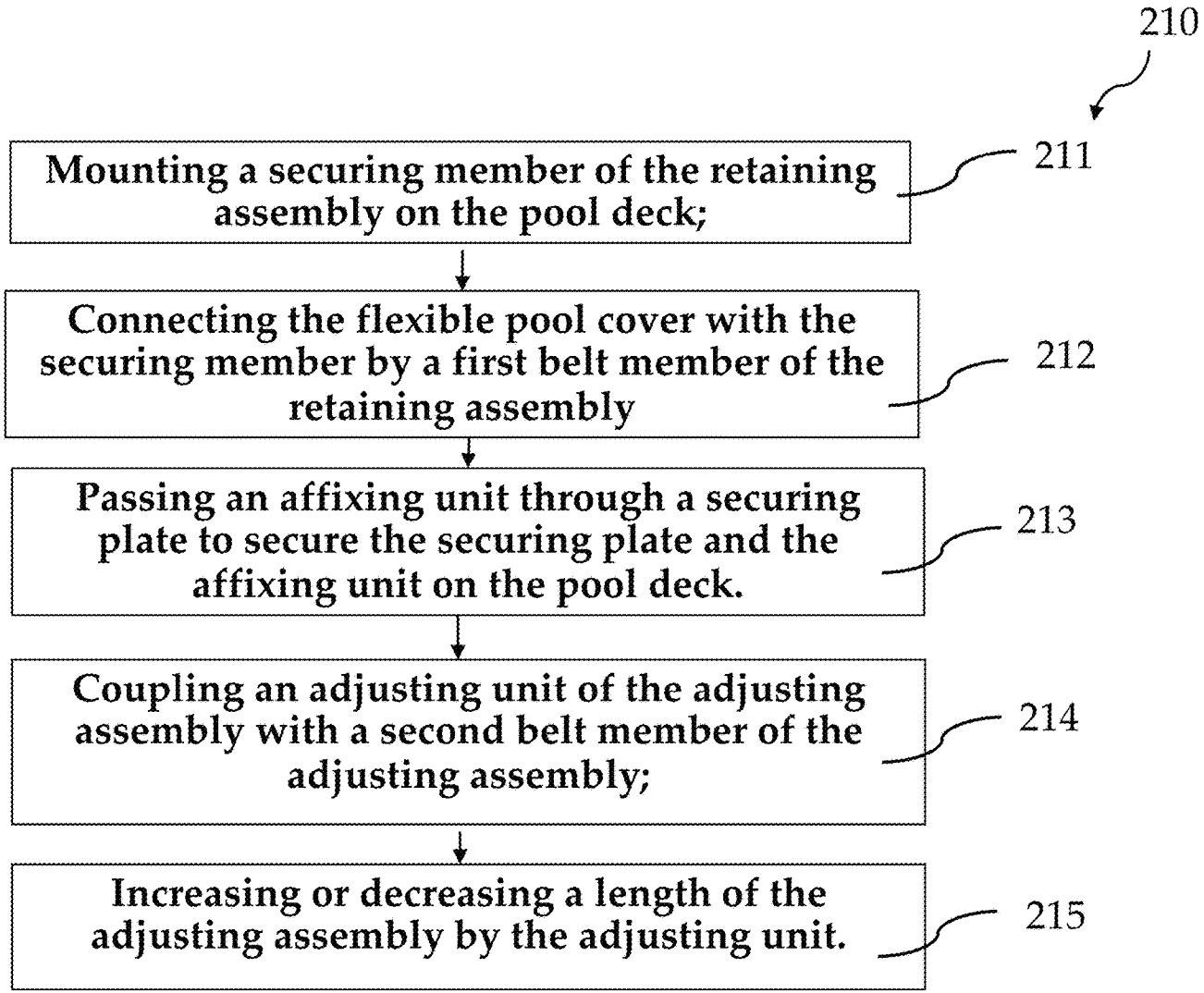

Referring to FIG. 11, the step of attaching the flexible pool cover on the pool deck by the retaining assembly 210 may further comprise steps of:

- mounting a securing member of the retaining assembly on the pool deck 211; and
- connecting the flexible pool cover with the securing member by a first belt member of the retaining assembly 212.

In one embodiment, (as shown in FIG. 3) the securing member 111 may comprise a securing plate 1112 placed on the pool deck 13 and an affixing unit 1111 knocked into the pool deck 13, wherein the affixing unit 1111 may be passed through the securing plate 1112 and be inserted into the pool deck 13.

Continuing to FIG. 11, the step of attaching the flexible pool cover on the pool deck by the retaining assembly 210 may further comprise steps of:

- passing the affixing unit of the securing member through the securing plate of the securing member to secure the securing plate and the affixing unit on the pool deck 213.

In one embodiment, the step of attaching the flexible pool cover on the pool deck by the retaining assembly 210 may further comprise steps of:

- coupling an adjusting unit of the adjusting assembly with a second belt member of the adjusting assembly 214; and
- increasing or decreasing a length of the adjusting assembly by the adjusting unit 215.

In still one embodiment, (as shown in FIG. 6 and FIG. 7) the second belt member 141 may comprise one end coupled with the adjusting unit 142 and an opposite end coupled to an opposite end of the first belt member 112, wherein the one end of the second belt member 141 may be opposite of the opposite end of the second belt member 141. In still one embodiment, the opposite end of the first belt member 112 may be coupled to the flexible pool cover 12 and one end of first belt member 112 may be attached with the securing member 111, wherein the one end of the first belt member 112 may be opposite of the opposite end of the first belt member 112.

Figure 12:
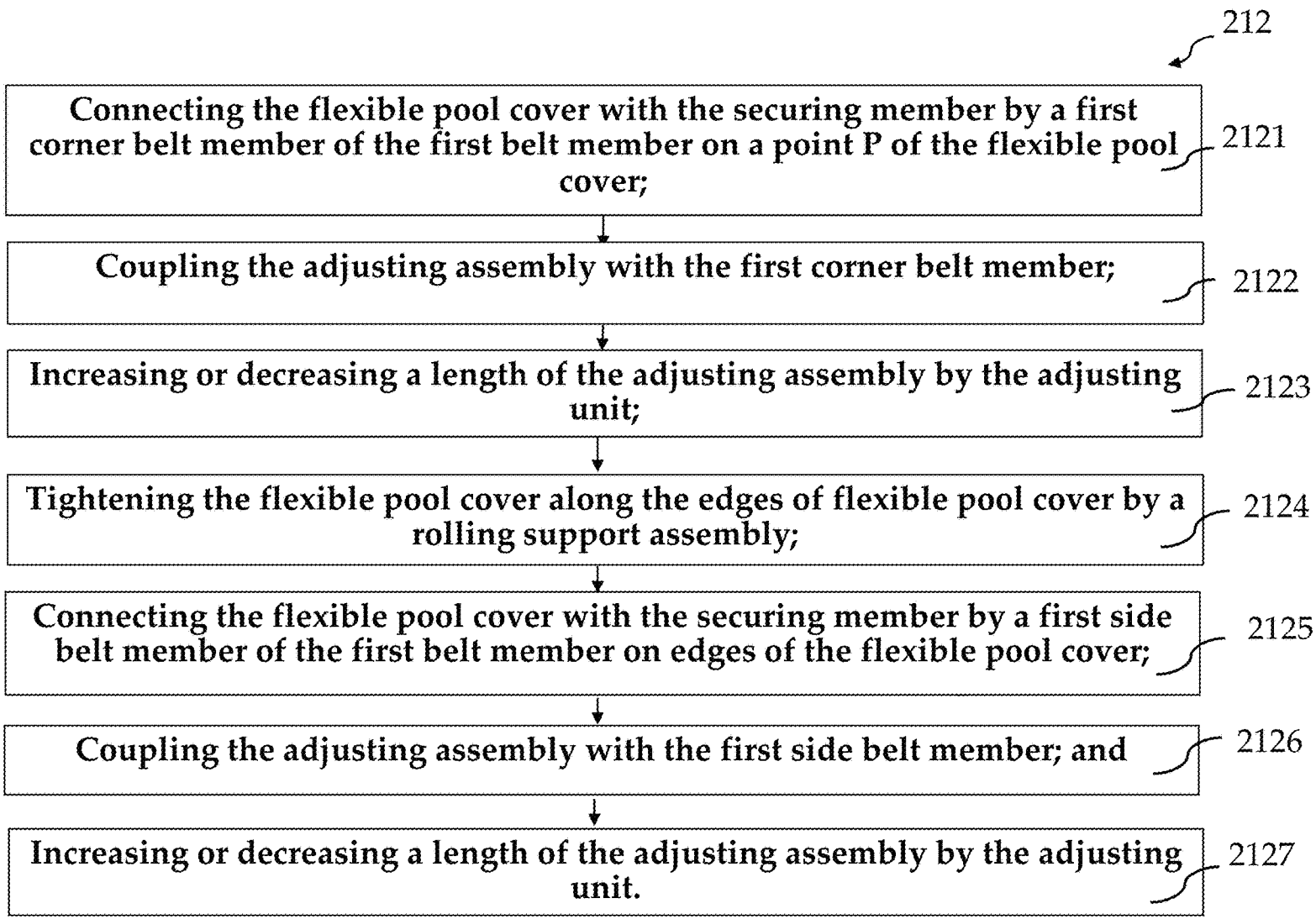

Referring to FIG. 12, in one embodiment, the step of connecting the flexible pool cover with the securing member by a first belt member of the retaining assembly 212 may further comprise steps of:

connecting the flexible pool cover with the securing member by a first corner belt member of the first belt member on a point P of the flexible pool cover 2121;

coupling the adjusting assembly with the first corner belt member 2122;

increasing or decreasing a length of the adjusting assembly by the adjusting unit 2123;

tightening the flexible pool cover along the edges of flexible pool cover by a rolling support assembly 2124;

connecting the flexible pool cover with the securing member by a first side belt member of the first belt member on edges of the flexible pool cover 2125;

coupling the adjusting assembly with the first side belt member 2126; and increasing or decreasing a length of the adjusting assembly by the adjusting unit 2127.

Figure 13:
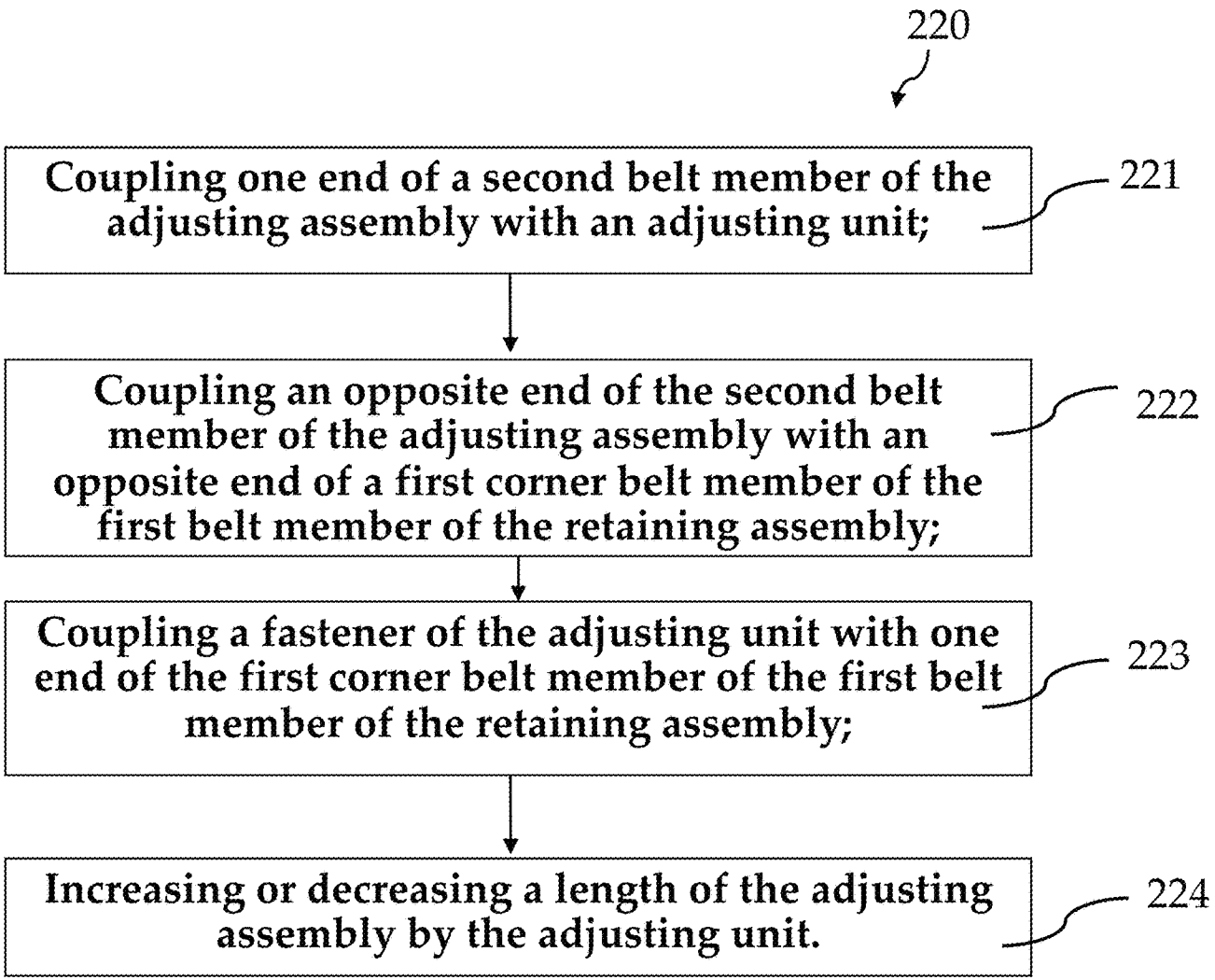

Referring to FIG. 13, in one embodiment, the step of extending and retracting the flexible pool cover by the adjusting assembly 220 may further comprise steps of:

coupling one end of the second belt member of the adjusting assembly with the adjusting unit 221;

coupling the opposite end of the second belt member of the adjusting assembly with the opposite end of the first corner belt member of the first belt member of the retaining assembly 222;

coupling the adjusting unit with the one end of the first corner belt member of the first belt member of the retaining assembly 223; and increasing or decreasing the length of the adjusting assembly by the adjusting unit 224.

Figure 14:
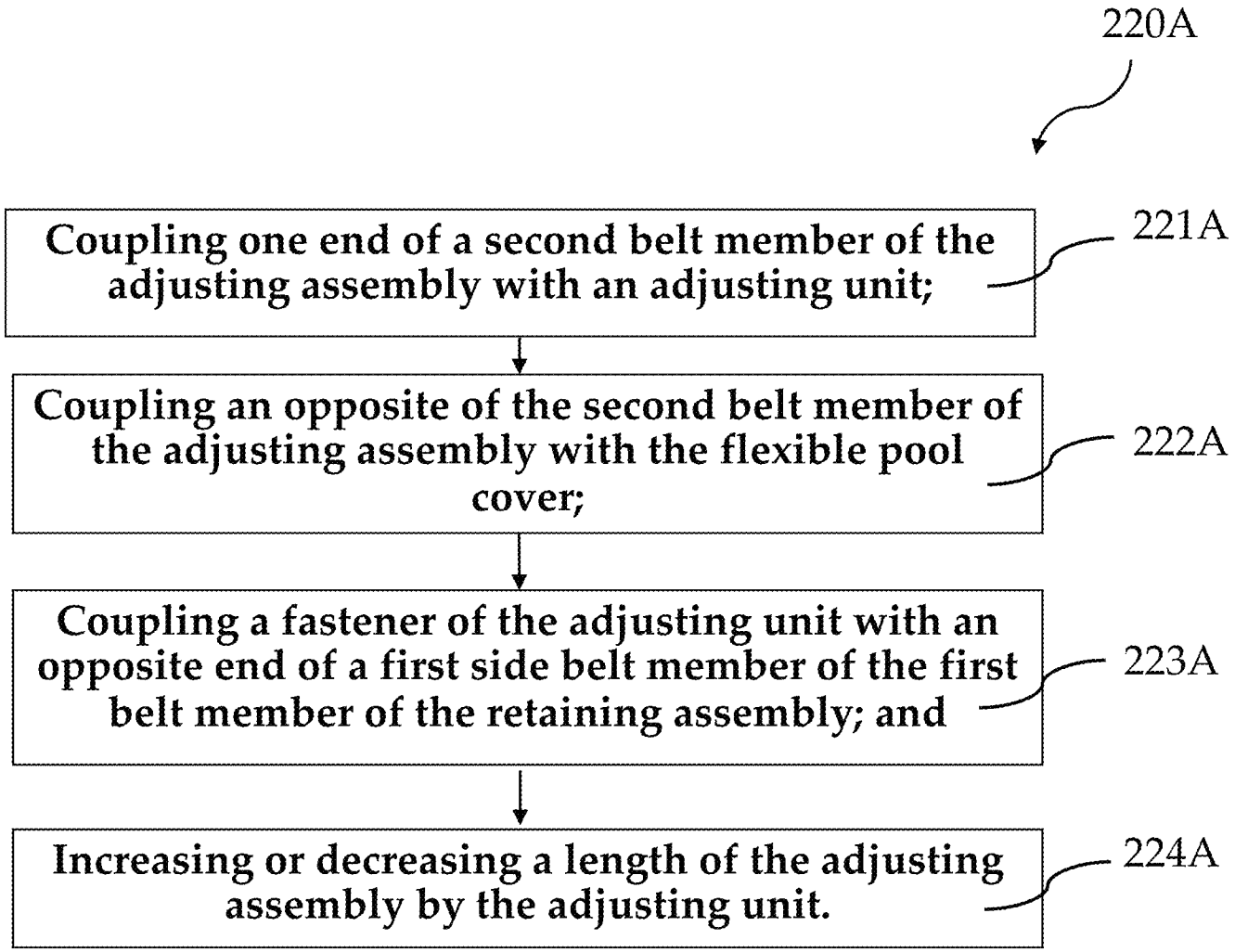

Referring to FIG. 14, in still one embodiment, the step of extending and retracting the flexible pool cover by the adjusting assembly 220A may further comprise steps of:

coupling one end of the second belt member of the adjusting assembly with the adjusting unit 221A;

coupling the opposite end of the second belt member of the adjusting assembly to the flexible pool cover 222A;

coupling the adjusting unit with the one end of the first side belt member of the first belt member of the retaining assembly 223A; and increasing or decreasing the length of the adjusting assembly by the adjusting unit 224A.

Figure 15:
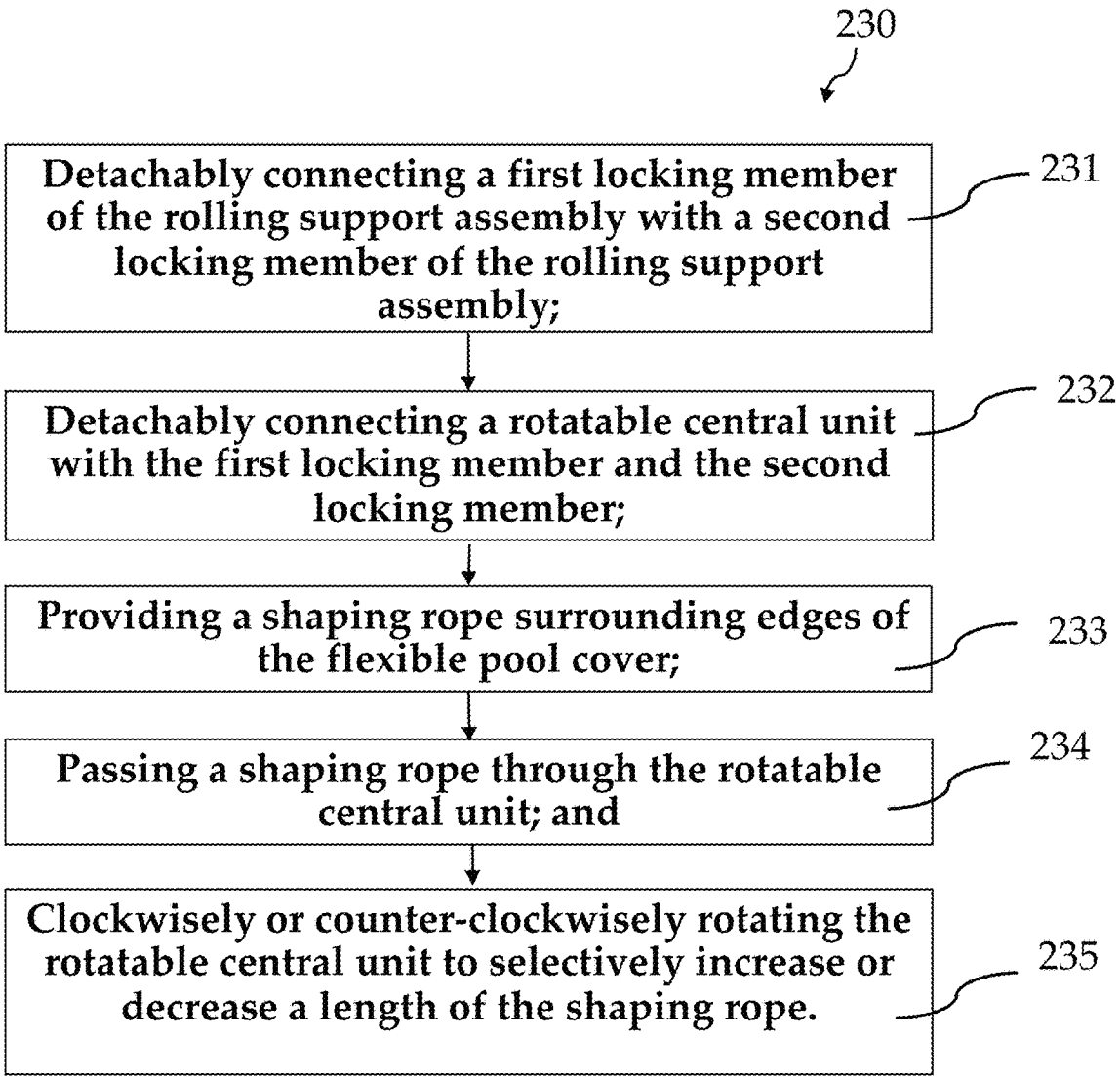

Referring to FIG. 15, in still one embodiment, the step of tightening the flexible pool cover along edges of the flexible pool cover by a rolling support assembly 230 may further comprise steps of:

connecting a first locking member of the rolling support assembly with a second locking member of the rolling support assembly 231;

connecting a rotatable central unit with the first locking member and the second locking member 232;

passing a shaping rope through the rotatable central unit 234; and clockwisely or counter-clockwisely rotating the rotatable central unit to selectively increase or decrease a length of the shaping rope (engage with or release the shaping rope) 235.

In one embodiment, (as shown in FIG. 9) the flexible pool cover 12 may comprise sleeves 121 formed on edges of the flexible pool cover 12, wherein the shaping rope 165 may be received inside the sleeves 121 to adjust the shape of the flexible pool cover 12.

In still one embodiment, (as shown in FIG. 8) the first locking member 161, the second locking member 162, the rotatable central unit 163, and the protrusion 164 may be detachable from each other.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more, or different elements, which are disclosed herein even when not initially claimed in such combinations.

Thus, specific embodiments and applications of the method and system of swimming pool cover have been disclosed. It should be apparent, however, to those skilled in the art that many more modifications besides those already described are possible without departing from the disclosed concepts herein. The disclosed embodiments, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The words used in this specification to describe the various embodiments are to be understood not only in the sense of their commonly defined meanings, but to include by special definition in this specification structure, material or acts beyond the scope of the commonly defined meanings. Thus, if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structures, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A swimming pool cover system, further comprising:

at least one retaining assembly configured for attachment of a flexible pool cover on a pool deck;

at least one adjusting assembly configured for extending and retracting the flexible pool cover; and at least one rolling support assembly attached along edges of the flexible pool cover and configured for tightening the edges the flexible pool cover.

2. The swimming pool cover system of claim 1, wherein the retaining assembly comprises a securing member mounted on the pool deck and a first belt member connected between the flexible pool cover and the securing member.

3. The swimming pool cover system of claim 2, wherein the first belt member comprises a first corner belt member and a first side belt member.

4. The swimming pool cover system of claim 1, wherein the retaining assembly comprises a securing member having a securing plate and an affixing unit passed through the securing plate to secure the securing plate and the affixing unit on the pool deck.

5. The swimming pool cover system of claim 1, wherein the adjusting assembly comprises a second belt member and an adjusting unit coupled with the second belt member, wherein the adjusting unit is configured to increase or decrease a length of the adjusting assembly.

6. The swimming pool cover system of claim 1, wherein the adjusting assembly comprises a second belt member and an adjusting unit coupled with the second belt member, wherein the adjusting unit comprises one end coupled with a second belt member and an opposite end coupled with the retaining assembly.

7. The swimming pool cover system of claim 1, wherein the adjusting assembly comprises a second belt member having one end coupled with the adjusting unit and having an opposite end coupled with the flexible pool cover while the adjusting unit is coupled with a first side belt member of a first belt member of the retaining assembly.

8. The swimming pool cover system of claim 1, wherein the adjusting assembly comprises a second belt member having one end coupled with the adjusting unit and having an opposite end coupled with an opposite end of a first corner belt member of the first belt member of the retaining assembly while the adjusting unit is coupled with one end of a first corner belt member of a first belt member of the retaining assembly.

9. The swimming pool cover system of claim 1, wherein the rolling support assembly comprises a first locking member detachably connected with a second locking member, and a rotatable central unit detachably connected with the first locking member and the second locking member.

10. The swimming pool cover system of claim 9, wherein the rotatable central unit is clockwisely or counter-clockwisely rotated to selectively engage with or release the shaping rope.

11. The swimming pool cover system of claim 1, wherein the rolling support assembly comprises a rotatable central unit and a shaping rope surrounding edges of the flexible pool cover, wherein the shaping rope passes through the rotatable central unit.

12. A method of assembling a swimming pool cover system comprising steps of:

attaching a flexible pool cover on a pool deck by a retaining assembly;

extending and retracting the flexible pool cover by an adjusting assembly; and tightening edges of the flexible pool cover by the rolling support assembly.

13. The method of assembling the swimming pool cover system of claim 12, wherein the step of attaching the flexible pool cover further comprises steps of:

mounting a securing member of the retaining assembly on the pool deck; and connecting one end of a first belt member with a securing member and an opposite end of the first belt member with the flexible pool cover.

14. The method of assembling the swimming pool cover system of claim 12, wherein the step of attaching the flexible pool cover further comprises steps of:

passing an affixing unit of a securing member through a securing plate of a securing member to secure the securing plate and the affixing unit on the pool deck.

15. The method of assembling the swimming pool cover system of claim 12, wherein the step of extending and retracting the flexible pool cover by an adjusting assembly further comprises steps of:

coupling an adjusting unit of the adjusting assembly with a second belt member of the adjusting assembly; and increasing or decreasing a length of the adjusting assembly by the adjusting unit.

16. The method of assembling the swimming pool cover system of claim 12, wherein the step of extending and retracting the flexible pool cover further comprises steps of:

coupling one end of a second belt member of the adjusting assembly with an adjusting unit;

coupling an opposite end of the second belt member of the adjusting assembly with an opposite end of a first belt member of the retaining assembly;

coupling the adjusting unit with one end of the first corner belt member of the first belt member of the retaining assembly; and increasing or decreasing a length of the adjusting assembly by the adjusting unit.

17. The method of assembling the swimming pool cover system of claim 12, wherein the step of extending and retracting the flexible pool cover further comprises steps of:

coupling one end of a second belt member with an adjusting unit;

coupling an opposite end of the second belt member of the adjusting assembly with the flexible pool cover;

coupling the adjusting unit with one end of a first side belt member of the first belt member of the retaining assembly; and increasing or decreasing a length of the adjusting assembly by the adjusting unit.

18. The method of assembling the swimming pool cover system of claim 12, wherein the step of tightening the flexible pool cover further comprises steps of:

connecting a first locking member of the rolling support assembly with a second locking member of the rolling support assembly;

connecting a rotatable central unit with the first locking member and the second locking member;

passing a shaping rope through the rotatable central unit and surrounding edges of the flexible pool cover; and clockwisely or counter-clockwisely rotating the rotatable central unit to selectively engage with or release the shaping rope.

19. The method of assembling the swimming pool cover system of claim 18, wherein the first locking member, the second locking member, and the rotatable central unit are detachable from each other.

20. The method of assembling the swimming pool cover system of claim 12, wherein the steps of extending and retracting the flexible pool cover by an adjusting assembly comprise steps of:

connecting the flexible pool cover with a securing member by a first corner belt member of the first belt member;

coupling the adjusting assembly with the first corner belt member;

increasing or decreasing a length of the adjusting assembly by an adjusting unit;

connecting the flexible pool cover with the securing member by a first side belt member of the first belt member;

coupling the adjusting assembly with the first side belt member; and increasing or decreasing the length of the adjusting assembly by an adjusting unit.

* * * * *